US006619769B1

(12) United States Patent
Hammonds et al.

(10) Patent No.: US 6,619,769 B1
(45) Date of Patent: Sep. 16, 2003

(54) STORAGE DRAWER WEDGE ASSEMBLY

(75) Inventors: Marcus Malik Hammonds, Decatur, GA (US); Philip Ames Barber, Louisville, KY (US); Jeffrey Allen Britton, Evansville, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/481,863

(22) Filed: Jan. 12, 2000

(51) Int. Cl.[7] ..... A47B 88/00
(52) U.S. Cl. ..... 312/330.1
(58) Field of Search ..... 312/330.1, 333, 312/334.4, 334.5, 348.1, 236

(56) References Cited

U.S. PATENT DOCUMENTS 1,489,405 A 4/1924 Wheary
3,819,247 A * 6/1974 Evans ..... 312/330.1
4,549,774 A 10/1985 Bessinger et al.
4,700,994 A 10/1987 Rock et al.
5,795,044 A * 8/1998 Trewhella et al. ..... 312/333
5,860,717 A * 1/1999 Mizrahi ..... 312/322
6,099,098 A * 8/2000 Leong ..... 312/333
6,166,353 A * 12/2000 Senneville et al. ..... 219/385
6,191,391 B1 * 2/2001 Deo et al. ..... 219/407
6,193,336 B1 * 2/2001 Jencka ..... 312/9.57

* cited by examiner

*Primary Examiner*—Janet M. Wilkens
(74) *Attorney, Agent, or Firm*—H. Neil Houser; Armstrong Teasdale, LLP

(57) ABSTRACT

A storage drawer assembly for a freestanding range includes a base module, a storage drawer slidably connected to the base module, and a drawer insert attached to the storage drawer. The drawer insert includes a stop portion and a wedge portion. The wedge portion includes a first surface to prevent excessive deflection of the base module, and a second surface to center the drawer inside the base module.

20 Claims, 5 Drawing Sheets

STORAGE DRAWER WEDGE ASSEMBLY

BACKGROUND OF THE INVENTION

This invention relates generally to storage drawers and, more particularly, to a storage drawer assembly for a free-standing range oven.

Freestanding range ovens often include a storage drawer below the oven unit for the storage of pots, pans, broilers, cookie sheets, etc. See, for example, U.S. Pat. No. 3,819,247. This type of drawer is typically contained within a base that supports the oven above the floor. The base typically is a shell structure having a front face opening through which the drawer extends.

During shipping and handling of a range unit with such a drawer, the relatively thin walls of the base shell may deflect. Unfortunately, this deflection tends to compromise the integrity of the base, interfere with the opening and closing of the drawer, and render the range aesthetically unappealing.

Furthermore, the slidably connected drawers of such units tend to stick or jam if they are not properly centered within the shell base. Aside from sticking and jamming, a drawer that is off center with the base further detracts from the appearance of the range unit.

Accordingly, it would be desirable to provide a storage drawer assembly that would prevent, or reduce, deflection of the base shell walls. In addition, it would be desirable if the storage drawer assembly reduced the likelihood of the drawer jamming. Further, it would be desirable to preserve the aesthetic appeal of the range.

BRIEF SUMMARY OF THE INVENTION

In an exemplary embodiment of the invention, a storage drawer assembly includes a base module, a storage drawer and a drawer insert. The drawer insert prevents, or reduces, deflection of the base module and misalignment of the drawer as it closes.

The base module includes a shell frame enclosure for a storage drawer including side walls and a face plate. The storage drawer is slidably connected to the base module and moveable through an opening in the base module between an open extended position and a closed retracted position. A drawer insert is attached to the side wall of the storage drawer adjacent the face plate and includes a stop portion extending substantially perpendicular to the drawer side wall and a wedge portion extending substantially parallel to the drawer side wall. The stop portion contacts the opening of the base module when the drawer is in the closed position.

The wedge portion prevents deflection of the base module shell beyond a predetermined distance between the wedge portion and the side of the shell frame. When the shell deflection is great enough that the shell contacts the wedge portion, the wedge portion transfers deflective force to the storage drawer and further deflection is prevented.

The wedge portion is tapered and slopes toward the side wall of the storage drawer. When the storage drawer is misaligned with respect to the opening through which it extends, the wedge contacts the opening and gradually guides the storage drawer into a proper position as it closes.

The storage drawer assembly therefore prevents, or reduces deflection of the base module, keeps the drawer in a centered position relative to the base module, and preserves the aesthetics of the range.

DETAILED DESCRIPTION OF THE INVENTION

Figure 1:
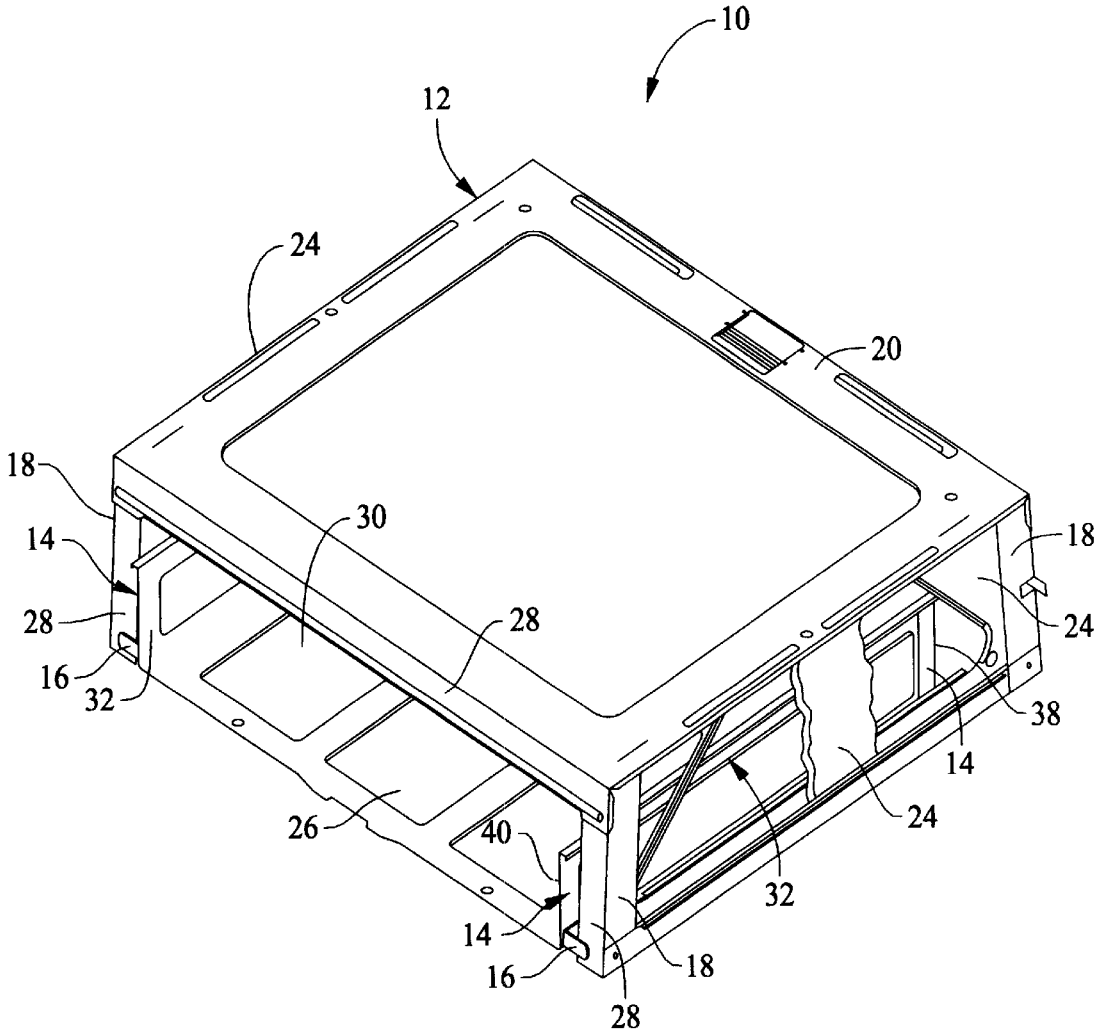
FIG. 1 is a perspective view of a portion of a storage drawer assembly in a closed position.

FIG. 1 is a partial perspective view of a storage drawer assembly 10 including a base module 12, a storage drawer 14 and a drawer insert 16. Drawer insert 16 prevents, or reduces, deflection of base module 12 during shipping and handling and prevents misalignment of drawer 14 within base module 12.

Base module 12 includes a plurality of substantially upright posts 18 connected to a module top 20 and forming a shell frame. Upright posts 18 support a range (not shown) above a floor. A plurality of interior walls 24 (shown partially broken away in FIG. 1) are attached to upright posts 18 and extend between module top 20 and upright posts 18 to form an enclosure 26. Base module 12 further includes a front face 28 that includes an opening 30 therethrough and allows access to enclosure 26.

Figure 2:
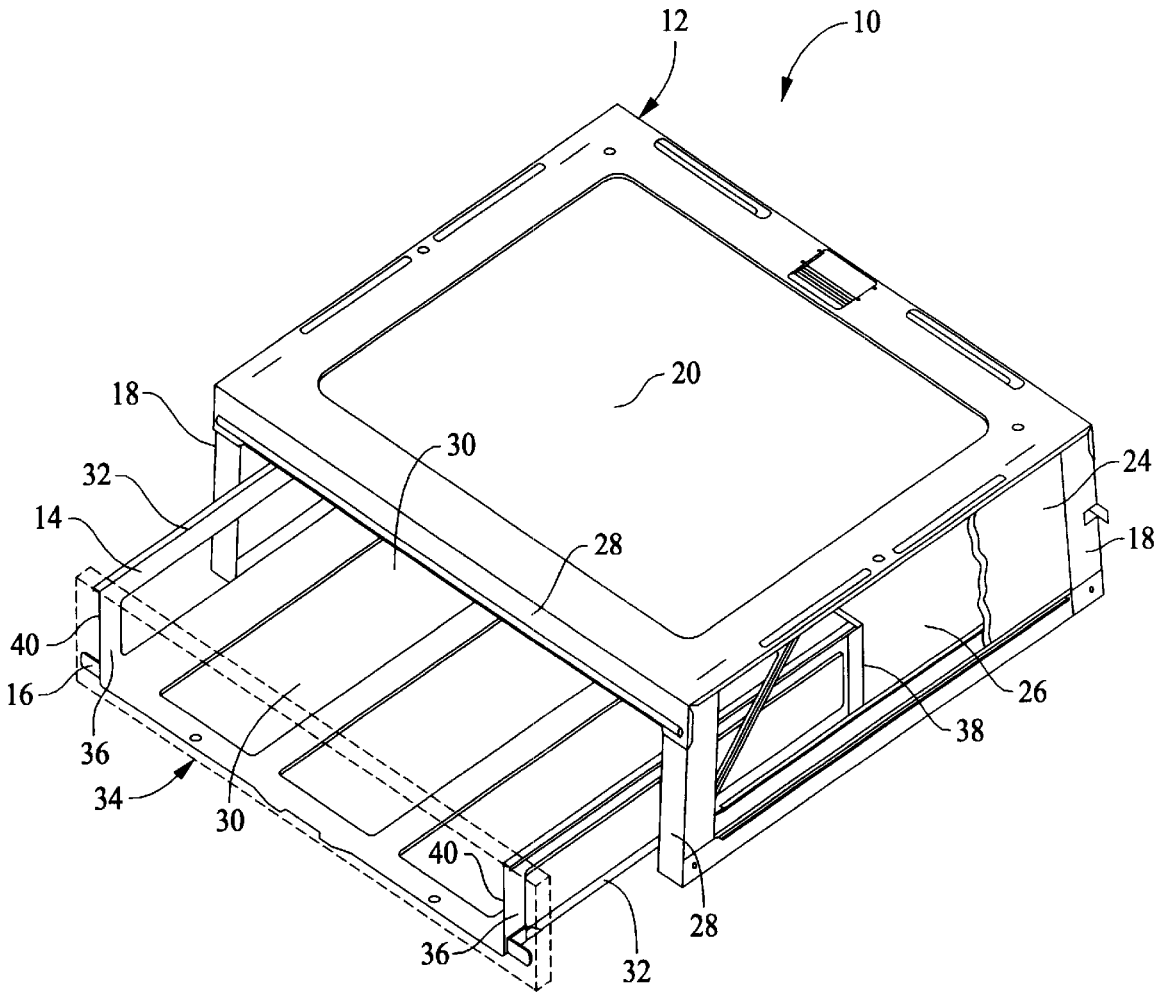
FIG. 2 is a perspective view of the assembly shown in FIG. 1 in an open position.

Storage drawer 14 includes a pair of side walls 32 and a face plate 34 (shown in phantom in FIG. 2). Each side wall 32 has a front end 36 and a back end 38. Front ends 36 include a leading edge 40. A drawer insert 16 is attached to each side wall 32 at front end 36, and face plate 34 is also attached to side walls 32 at their front ends 36. Storage drawer 14 further includes a drawer bottom (not shown) and a rear plate (not shown) attached to drawer side walls 32 at their back ends 38. Storage drawer 14 is substantially rectangular.

In an alternative embodiment, more than one drawer insert 16 is attached to one or both side walls 32. In a further alternative embodiment, one or more drawer inserts 16 are attached to only one of side walls 32.

Storage drawer 14 is slidably connected to base module 12 and extends through opening 30 into enclosure 26. Storage drawer 14 is slidable between a retracted closed position (FIG. 1) and an extended open position (FIG. 2). In the closed position, only front ends 36 of side walls 32 extend through opening 30 and the remainder of storage drawer 14 is contained within, and substantially fills, enclosure 26.

FIG. 2 illustrates drawer in an open position where back ends 38 of drawer side walls 32 approach front face 28 of base module 12. Interior walls 24 extend between upright posts 18 and module top 20 to form an enclosure 26 that is only partially occupied by storage drawer 14. Face plate 34 (shown in phantom) and drawer insert 16 are sufficiently separated from base module opening 30 so that items may be placed into or removed from drawer 14.

Figure 3:
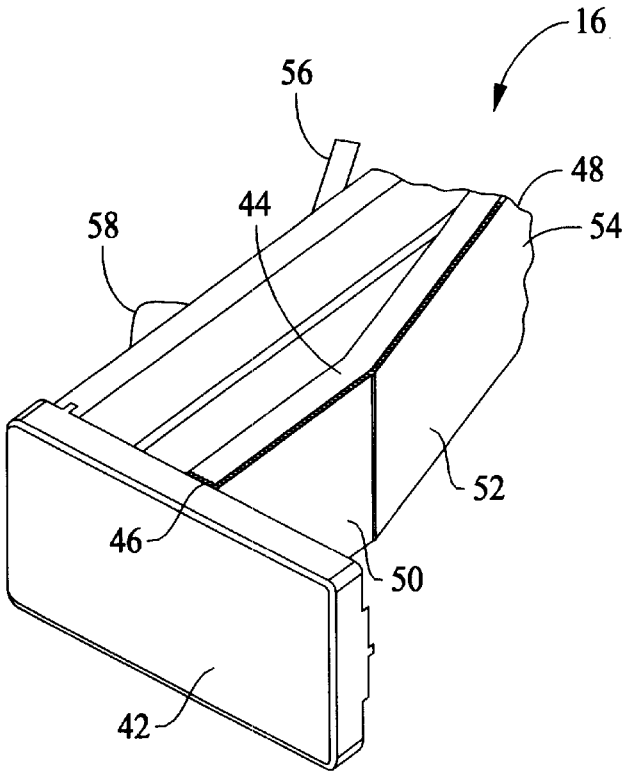
FIG. 3 a perspective view of a drawer insert.

FIG. 3 illustrates drawer insert 16 including a stop portion 42 and a wedge portion 44. Stop portion 42 is generally rectangular and extends substantially perpendicular to wedge portion 44. Wedge portion 44 is connected to stop portion 42 at a proximal end 46 and extends toward a distal end 48. Wedge portion 44 further includes a first surface 50 and a second surface 52. First surface 50 extends from proximal end 46 substantially perpendicular to stop portion 42. Second surface 52 is oblique to first surface 50 and forms a ramp, gradually reducing the cross sectional area of wedge portion 44 as distal end 48 is approached. Distal end 48 includes a rounded taper 54. Drawer insert 16 also includes a tab 56 and a snap 58 for attachment to a storage drawer sidewall 32.

Figure 4:
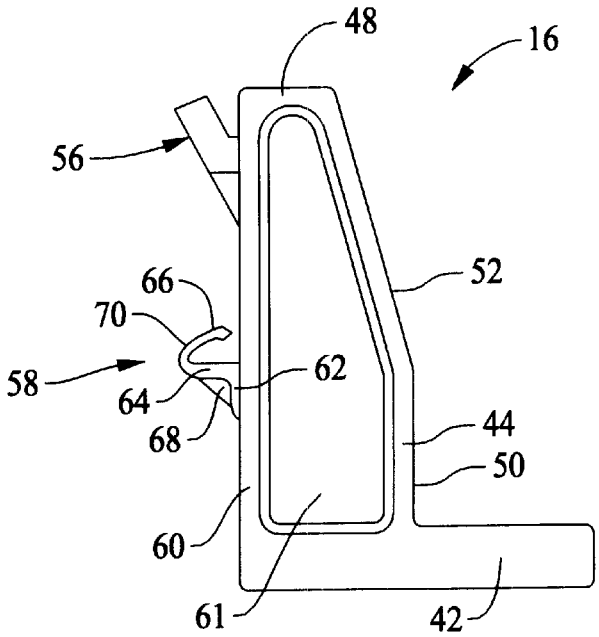
FIG. 4 is a top plan view of the drawer insert shown in FIG. 3.

FIG. 4 is a top plan view of drawer insert 16. Stop portion 42 extends beyond substantially perpendicular wedge portion 44, giving drawer insert 16 an L-shaped appearance. Wedge portion first surface 50 upwardly extends from the approximate mid-section of stop portion 42. An attachment wall 60 is attached to stop portion 42 at one end, and extends substantially parallel to wedge portion first surface 50. Attachment wall 60 joins wedge portion second surface 52 at tapered wedge portion distal end 48. Attachment wall 60 and wedge portion first and second surfaces 50, 52 are separated by a depressed portion 61, giving wedge portion 44 an I-beam shaped cross section across a plane parallel to stop portion 42.

Tab 56 extends obliquely from attachment wall 60 for insertion into a slot (not shown) in a drawer side wall (not shown). Snap 58 includes a first portion 62 that is substantially parallel to attachment wall 60, a second portion 64 that is substantially perpendicular to attachment wall 60, and a third portion 66 that is oblique to the first portion 62 and the second portion 64. A reinforcing rib 68 joins the first snap portion 62 and the second snap portion 64, and the third snap portion 66 extends from a distal end 70 of second snap portion 64 toward attachment wall 60. Snap 58 is resiliently flexible upon insertion into a hole (not shown) in a drawer sidewall (not shown) and "snaps back" to its original configuration when snap third portion 66 is fully inserted through the drawer side wall. A section of attachment wall 60 is slightly depressed underneath snap third portion 66 to facilitate flexing of snap 58.

Figure 5:
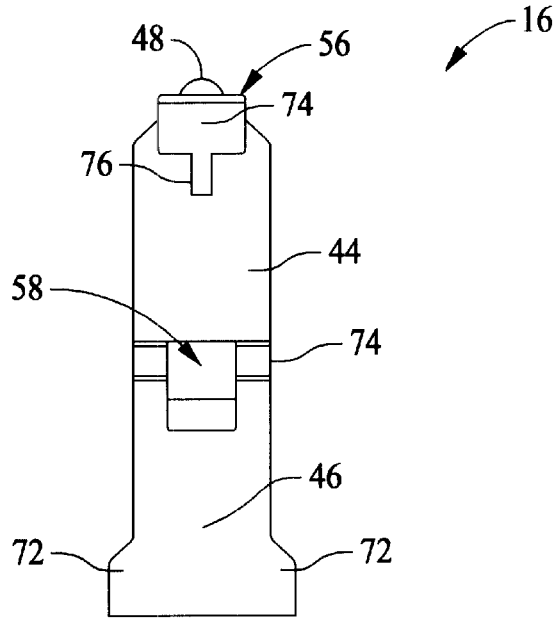
FIG. 5 is a rear plan view of the drawer insert shown in FIG. 5.

FIG. 5 is a rear view of drawer insert 16 including stop portion tapers 72 at distal end 46 of wedge portion 44. Attachment wall 60 depressed section 74 extends the width of wedge portion 44, and snap 58 is located over depressed section 74. Tab 56 includes a head portion 76 and a neck portion 78 at wedge portion distal end 48. Tab head 76 prevents unintended separation of drawer insert 16 from a drawer side wall 32 (shown in FIGS. 1 and 2) once tab 56 is inserted into a slot (not shown) therein.

Figure 6:
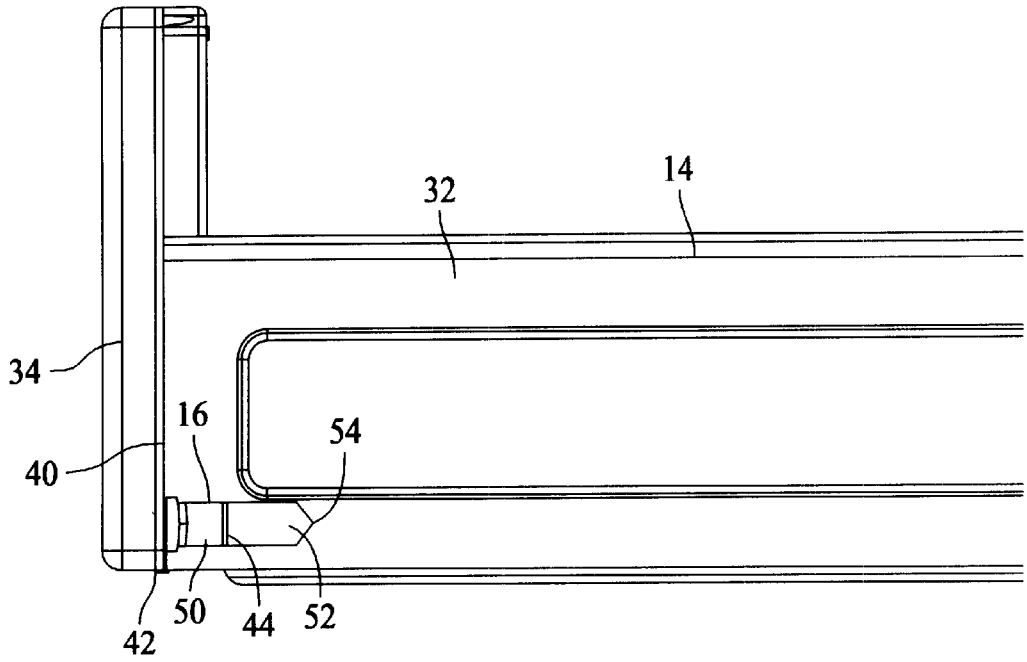
FIG. 6 is a partial side elevational view of a storage drawer including a drawer insert.

FIG. 6 illustrates drawer insert 16 attached to storage drawer 14. Wedge portion 44 is attached to drawer side wall 32 adjacent leading edge 40. Face plate is attached to leading edge 40, and stop portion 42 contacts face plate 34 and extends parallel to face plate 34. Wedge portion 44 extends perpendicular to stop portion 42 along drawer side wall 32. Wedge first surface 50 extends from stop portion 42 to second surface 52 which extends to taper 54.

Figure 7:
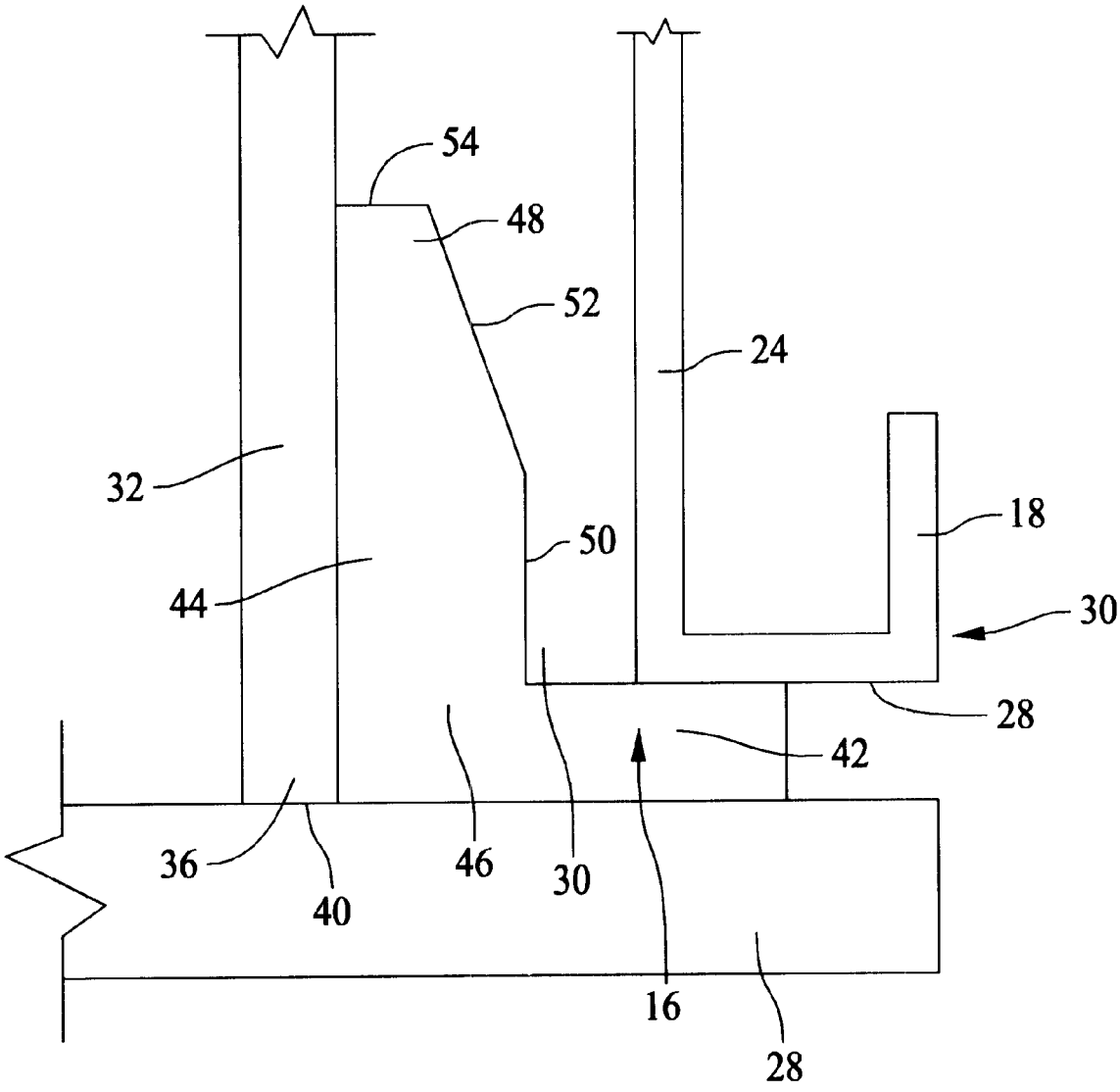
FIG. 7 is a partial cross section of the storage drawer assembly shown in FIG. 1.

FIG. 7 is a partial cross sectional view of storage drawer assembly 10 in the closed position. Drawer insert is attached to drawer sidewall via tab 56 (not shown) and snap 58 (not shown). Stop portion 42 of drawer insert 16 extends substantially perpendicular to drawer side wall 32 and substantially parallel to leading edge 40. First surface 50 of wedge portion 44 extends substantially parallel to drawer side wall 32. Second surface 52 of wedge portion 44 extends obliquely to drawer side wall 32. Taper 54 of distal end 48 is positioned rearward of stop portion 42.

In the closed position, stop portion 42 contacts front face 28 of base module 30. Wedge portion 44 extends from stop portion 42 through opening 30 along side wall 32. First surface 50 is separated from interior wall 24 of base module 12 by about 0.05 inches. The separation allows for a small deflection of interior wall 24 and allows clearance for storage drawer 14 to be opened and closed. If interior wall 24 deflects more than about 0.05 inches, interior wall 24 contacts first surface 50 and transmits a force to side wall 32 of storage drawer 14. The rigidity of storage drawer 14 prevents interior wall 24 from deflecting further. In alternative embodiments, greater or lesser separation than about 0.05 inches between wedge portion first surface 50 and interior wall 24 is employed.

When closing storage drawer 14, wedge portion second surface 52 keeps storage drawer 14 in proper alignment with base module 12. If storage drawer 14 is not centered within opening 30, second surface 52 contacts front face 28 as drawer 16 is closed, and ramped second surface 52 gradually guides storage drawer 14 into proper alignment within opening 30 and base module 12. Taper 54 reduces impact and large frictional forces upon initial contact of front face 28 and second surface 52. Once properly aligned, first surface 50 is properly oriented in relation to interior wall 24, and storage drawer 14 is fully closed when stop portion 42 contacts front face 28 of base module 12.

A method for protecting a storage drawer assembly 10 includes attaching drawer insert 16 to side wall 32 of storage drawer 14 adjacent leading edge 40. Drawer insert is positioned so that stop portion 42 extends perpendicular to side wall 32, wedge portion 44 extends parallel to side wall 32, and second surface 52 is rearward of first surface 50. A second drawer insert 16 may be attached to a second side wall 32 so that a second stop portion 42 extends perpendicular to a second side wall 32 and a second wedge portion 44 extends parallel to second side wall 32. If more than one drawer insert 16 is used, inserts 16 are aligned in pairs at similar locations on side walls 32 to properly center storage drawer 14 as it is closed. Drawer 14 is then inserted into enclosure 26 through opening 30 and closed so that stop portions 42 contact front face 28 of base module 12.

By preventing or reducing deflection of base module interior walls 24, and further by preventing misalignment and jamming of storage drawer 14 within base module 12, drawer inserts 16 preserve the aesthetics of a range unit and facilitate smooth, dependable opening and closing of storage drawer 14.

While the invention has been described in terms of various specific embodiments, those skilled in the art will recognize that the invention can be practiced with modification within the spirit and scope of the claims.

What is claimed is:

1. A storage drawer assembly for a range, said assembly comprising:

a base module comprising a front face including an opening therethrough;

a storage drawer slidably connected to said base module and extending through said opening, said storage drawer comprising a face plate; and at least one drawer insert connected to said drawer, said insert comprising a stop portion and a wedge portion, said stop portion contacting said face plate and extending substantially parallel to said front face, said wedge portion extending through said opening and substantially perpendicular to said front face.

2. A storage drawer assembly for a range, said assembly comprising:

a base module comprising a front face including an opening therethrough;

a storage drawer slidably connected to said base module and extending through said opening, said storage drawer comprising at least one side wall; and at least one drawer insert connected to said drawer, said insert comprising a stop portion and a wedge portion, said wedge portion comprising a first surface and a second surface, said first surface extending substantially parallel to said side wall, said second surface extending from said first surface toward said side wall, said stop portion extending substantially parallel to said front face, said wedge portion extending through said opening and substantially perpendicular to said front face.

3. A storage drawer assembly in accordance with claim 2 wherein said side wall includes a leading edge, said drawer insert attached to said side wall adjacent said leading edge.

4. A storage drawer assembly in accordance with claim 2 wherein said wedge portion further includes a proximal end and a distal end that is tapered.

5. A storage drawer assembly in accordance with claim 4 wherein said tapered distal end is rounded.

6. A storage drawer assembly in accordance with claim 2 wherein said base module further comprises an interior wall, said drawer slidable between an open position and a closed position, said wedge portion separated from said interior wall when said drawer is in said closed position.

7. A storage drawer assembly in accordance with claim 2 wherein said drawer insert includes a tab and a snap for connecting said drawer insert to said drawer.

8. A storage drawer assembly in accordance with claim 2 wherein said stop portion and said wedge portion are substantially perpendicular.

9. A storage drawer assembly for a range, said assembly comprising:

a base module comprising a frame, said frame including a front face including an opening therethrough;

a drawer slidably connected to said base module and extending through said opening, said drawer slidable between an open position and a closed position; and a drawer insert connected to said drawer, said insert comprising a stop portion and a wedge portion, said stop portion contacting said front face of said frame when said drawer is in the closed position.

10. A storage drawer assembly in accordance with claim 9, wherein said drawer comprises at least one side wall, said wedge portion comprises a first surface and a second surface, said first surface extending substantially parallel to said side wall, said second surface extending from said first surface toward said side wall.

11. A storage drawer assembly in accordance with claim 10 wherein said drawer includes a tab and a snap for connecting said drawer insert to said drawer.

12. A storage drawer assembly in accordance with claim 9 wherein said side wall comprises a front end, said drawer insert connected to said side wall at said front end.

13. A storage drawer assembly in accordance with claim 9 wherein said wedge portion further comprises a proximal end and a distal end that is tapered.

14. A storage drawer assembly in accordance with claim 13 wherein said tapered distal end is rounded.

15. A storage drawer assembly in accordance with claim 9 wherein said base module further comprises an interior wall attached to said frame, said wedge portion separated from said interior wall when said drawer is in said closed position.

16. A storage drawer assembly in accordance with claim 9 wherein said stop portion and said wedge portion are substantially perpendicular.

17. A method for protecting a storage drawer assembly, the assembly including a base module having a front face including an opening, the assembly further including a drawer having at least a first side wall slidably connected to the base module and extending through the opening therein and a first drawer insert including a first stop portion and a first wedge portion, the method comprising the steps of:

attaching the first wedge portion to the first side wall so that the first stop portion of the insert extends substantially perpendicularly to the first side wall and the first wedge portion of the first insert extends substantially parallel to the first side wall;

inserting the drawer into the base module opening; and closing the drawer until the stop portion of the insert contacts the front face of the frame.

18. A method in accordance with claim 17 wherein the drawer further includes a second side wall adjacent the front face, the assembly further including a second drawer insert, said second insert including a second stop portion and a second wedge portion, the method further comprising the step of attaching the second wedge portion to the second side wall so that the second insert stop portion extends substantially perpendicular to the second side wall and the second insert wedge portion extends substantially parallel to the second side wall.

19. A method in accordance with claim 18 wherein the drawer further includes a face plate connected to the side walls, the drawer slidable between an open extended position and a closed retracted position, the method further comprising the step of adjusting the first wedge portion attached to the first side wall and the second wedge portion attached to the second side wall until both stop portions are flush with the front face and the face plate is centered in the opening when the drawer is in the closed position.

20. A method in accordance with claim 17 wherein the drawer includes a front end and a back end, the wedge portion includes a first surface and a second surface, said step of attaching the insert to the side wall further comprises the step of positioning the second surface of the wedge portion rearward of the first surface and extending the second surface toward the side wall.

* * * * *